United States Patent [19]

Mortensen

[11] 4,418,289

[45] * Nov. 29, 1983

[54] TWO STAGE STARTER DRIVE SYSTEM

[75] Inventor: Harold R. Mortensen, Horseheads, N.Y.

[73] Assignee: Facet Enterprises, Incorporated, Tulsa, Okla.

[ * ] Notice: The portion of the term of this patent subsequent to Dec. 8, 1998 has been disclaimed.

[21] Appl. No.: 223,539

[22] Filed: Jan. 8, 1981

Related U.S. Application Data

[63] Continuation of Ser. No. 962,353, Nov. 20, 1978, Pat. No. 4,305,002.

[51] Int. Cl.[3] ..... F02N 11/00

[52] U.S. Cl. ..... 307/142; 361/189; 361/194; 361/154; 290/38 R; 290/48; 290/DIG. 1

[58] Field of Search ..... 290/38 R, 48, DIG. 1; 74/7 A, 7 R; 123/179 R, 179 B, 38 A, 36 R; 307/142; 361/194, 189, 154

[56] References Cited

U.S. PATENT DOCUMENTS

| | | | |
|---|---|---|---|
| 2,727,158 | 12/1955 | Seilly | 290/38 X |
| 3,597,622 | 4/1970 | Wilson | 290/38 R |
| 3,866,960 | 2/1975 | Chohan | 290/38 R |

*Primary Examiner*—G. Z. Rubinson
*Assistant Examiner*—James L. Dwyer
*Attorney, Agent, or Firm*—Remy J. VanOphem

[57] ABSTRACT

A two stage positive shift starter drive system for an internal combustion engine is disclosed. A pair of electrical switches are sequentially actuated by an actuator solenoid engaging the starter drive's pinion gear with the engine's ring gear. The first switch actuated after a predetermined displacement of the solenoid's armature applies electrical power to the cranking motor through a resistance connected in series with the cranking motor and connected in parallel with the solenoid pull-in coil. The resistance reduces the electrical power applied to the cranking motor and the potential across the solenoid pull-in coil thereby reducing the rotational speed and the engagement force applied to the pinion gear. The end of the armature travel closes the second switch applying full power to the cranking motor permitting normal cranking of the engine with the pinion gear fully engaged with the ring gear.

2 Claims, 3 Drawing Figures

TWO STAGE STARTER DRIVE SYSTEM

This is a continuation of application Ser. No. 962,353 filed Nov. 20, 1978, now U.S. Pat. No. 4,305,002.

BACKGROUND OF THE INVENTION

I. Field of the Invention

The present invention relates to starter drives for an internal combustion engine and, specifically, to a control circuit which applies electrical power to the starter drive in two stages; the first stage being a reduced power level permitting slow engagement of the driving gear of the starter and the driven gear of the engine and the second stage applying full power to the cranking motor cranking the engine at normal speed.

II. Description of the Prior Art

Two stage starter drive systems employing a resistor in a circuit in order to decrease the power of the electric starting motor in a first stage are well known in the art.

West in U.S. Pat. No. 3,584,229 discloses a solenoid having an E shaped core with two windings thereon in order to include a resistor in the series to effect starting of an engine.

A number of systems and improvements thereon have been developed for use with quick-pitch screw-thread type starters. Seilly in U.S. Pat. Nos. 3,124,694; 3,210,554 and 3,399,576 disclose improvements in systems which include a resistance for such a starter. All of these circuits are used in conjunction with a plurality of catch balls which secure a sleeve to the motor shaft when the driving gear is engaged with the driven gear of the engine. These balls prevent inadvertent return of the sleeve to its rest position before the engine is fully started. Similarly, Gubb and Seilly in U.S. Pat. No. 3,358,667 disclose an improved circuit for including a resistance in a quick-pitch screw-thread starting mechanism. Seilly, in U.S. Pat. No. 3,469,106, discloses a similar circuit with a resistance from the motor control circuit. In U.S. Pat. No. 2,727,158, Seilly discloses a further improvement for a quick-pitch screw-thread starter drive mechanism. The improvement therein lies in the use of a catch as shown in FIGS. 1A and 2A of that patent. The novel catch is used to regulate the inclusion or exclusion of a resistance in the control circuit.

Circuits including a resistance to control the motor speed for starting are also known for positive shift starter drive systems. These include Broyden, U.S. Pat. No. 3,433,968, which disclosed a single set of contacts on the plunger of the solenoid which set of contacts act simultaneously with the positive shift arm to the pinion gear. Closing the circuit between these contacts effectively short circuits a parallel resistance circuit, which resistance circuit insures slow engagement of the driving and driven gears. Similarly, Chohan in U.S. Pat. No. 3,866,960 discloses a contact/armature structure and associated circuitry for controlling the power to the cranking motor by means of a parallel resistance circuit which employs a conventional electric relay.

SUMMARY OF THE INVENTION

The present invention is provided specifically for use with positive shift type starter drive systems wherein the electric cranking motor has an extended shaft with a pinion gear slidably mounted thereon and rotated by the motor shaft. A shift mechanism is connected to the armature of a solenoid actuator and operates to axially slide the pinion gear in one direction to engage, and in an opposite direction to disengage, the pinion gear and the cranking gear of the engine to be started. The solenoid actuator has pull-in and hold-in coils which effect the armature for movement thereof, thereby engaging and disengaging the driving or pinion gear with the engine's cranking gear.

Electrical power is supplied to the cranking motor through a pair of normally open electrical switches attached to the solenoid and sequentially actuated by the displacement of the solenoid's armature. Energization of the solenoid's coils initiates movement of the armature. After a predetermined displacement of the armature, the first switch is closed supplying electrical power to the motor through a resistance connected in series with the motor and in parallel with the solenoid's pull-in coil. The series resistance simultaneously reduces the electrical power to the motor, thereby reducing the motor shaft speed and the armature travel speed, to insure engagement of the pinion and driven gears into a meshed condition at reduced speeds. When the gears are completely meshed, the armature has traveled a further distance within the solenoid and closes the second switch. Closing of the second switch short circuits both the pull-in coil and the resistance and applies full power to the motor simultaneously which deactivates the pull-in coil. The hold-in coil has a separate ground which remains energized. The application of full power to the motor increases the rotational speed of the motor shaft to a speed sufficient to start the engine.

The disclosed starter drive system effect engagement of the pinion gear with the engine's driven gear at reduced power levels until the drive is fully engaged.

It is, therefore, an object of the present invention to provide a reliable two stage positive shift starter drive system with minor modifications to existing components.

It is a further object of the present invention to provide a two stage starter drive system which eliminates the abutment clearing mechanisms required on prior art systems.

It is still a further object of the present invention to make the starter drive system smaller by eliminating tooth abutment clearing mechanisms thereby permitting the use of smaller pinion gears than heretofore possible.

These and other objects of the present invention will become apparent from a better understanding of the invention gained by reference to the accompanying drawings wherein:

DESCRIPTION OF THE PREFERRED EMBODIMENT

Figure 1:
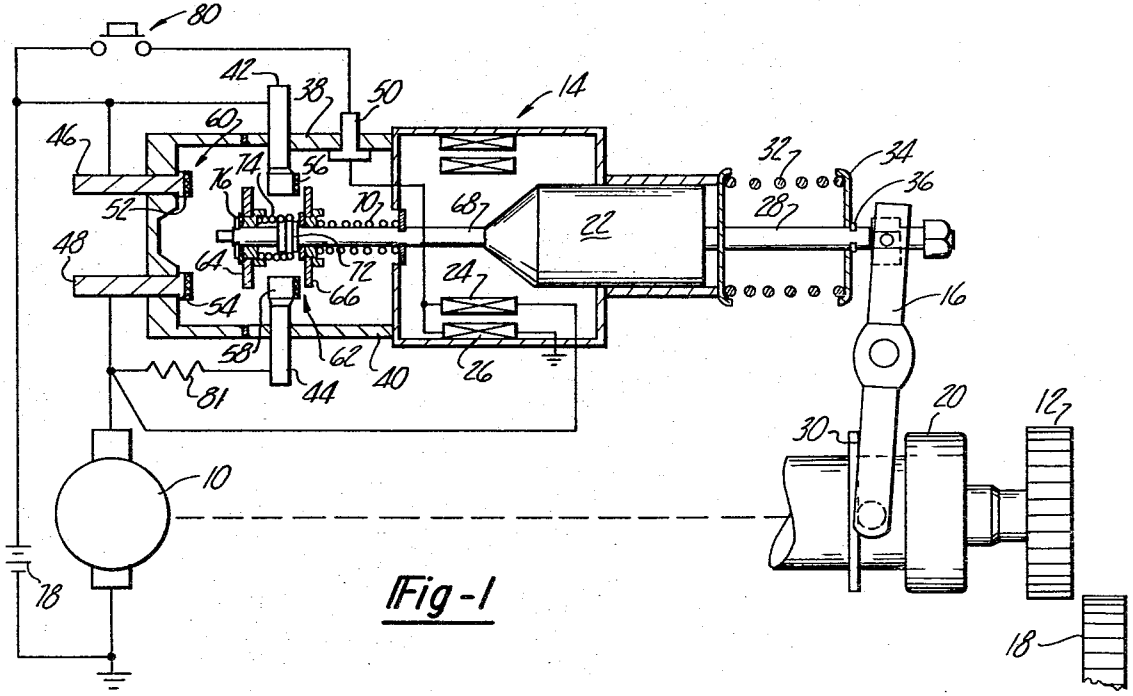
FIG. 1 shows the disclosed starter drive system in schematic form in its deenergized state with both switches in their normally open state.

Referring to FIG. 1, a positive shift electrical starter drive system is shown in schematic form. The starter drive system includes a cranking or starter motor 10 having a splined output shaft connected to a pinion gear 12, a solenoid actuator 14, and a shifting mechanism 16 operative to axially displace the pinion gear 12 along the splined shaft of the motor from a disengaged position to a position in which the pinion gear is fully engaged with an engine cranking gear 18 which is connected to the crankshaft of an engine, not shown. In a conventional starter system, the cranking gear 18 is a ring gear connected to the engine's flywheel, but may be any other gear which is capable of transferring the rotation of the pinion gear 12 to the engine's crankshaft when engaged.

The arrangement of the cranking motor 10, pinion gear 12, shifting mechanism 16, and the cranking gear 18 are of conventional design and their interrelationship need not be discussed in detail for an understanding of the invention. Briefly, when the solenoid actuator is energized, the shifting mechanism 16 displaces the disengaged pinion gear 12 into engagement with the cranking gear 18 and the cranking motor 10 drives the cranking gear 18 through the engaged pinion gear 12 until the engine starts. Conventionally, an override clutch, such as clutch 20, is provided between the pinion gear 12 and the motor shaft permitting the pinion gear to rotate freely after the engine is started at which time the rotational speed of the pinion gear 12 is greater than the rotational speed of the starter motor's output shaft.

The solenoid actuator 14 includes an armature 22 axially disposed within an annular shaped pull-in coil 24 and a concentric hold-in coil 26. The armature has an actuator shaft 28 extending rearwardly, i.e., to the right on the illustration of FIG. 1, and is pivotally connected to one end of the shifting mechanism 16. The other end of the shifting mechanism 16 is pivotally connected to a collar or yoke 30 attached to or formed in the pinion gear drive shaft as is known in the art. The shifting mechanism 16 is pivotally mounted at a point intermediate its two ends such that an axial movement of the armature 22 will, by means of the actuator shaft 28, rotate the shifting mechanism 16 about its intermediate pivot point and axially move the yoke 30 and the pinion gear 12 in a direction opposite to the movement of the armature. The armature is biased away from the pull-in and hold-in coils 24 and 26, respectively, by means of a resilient member, such as a coil spring 32 acting against a spring retainer 34 positionally restrained along the actuator shaft 28 by a stop such as a "C" ring 36 disposed in a groove formed in the actuator shaft 28.

Figure 3:
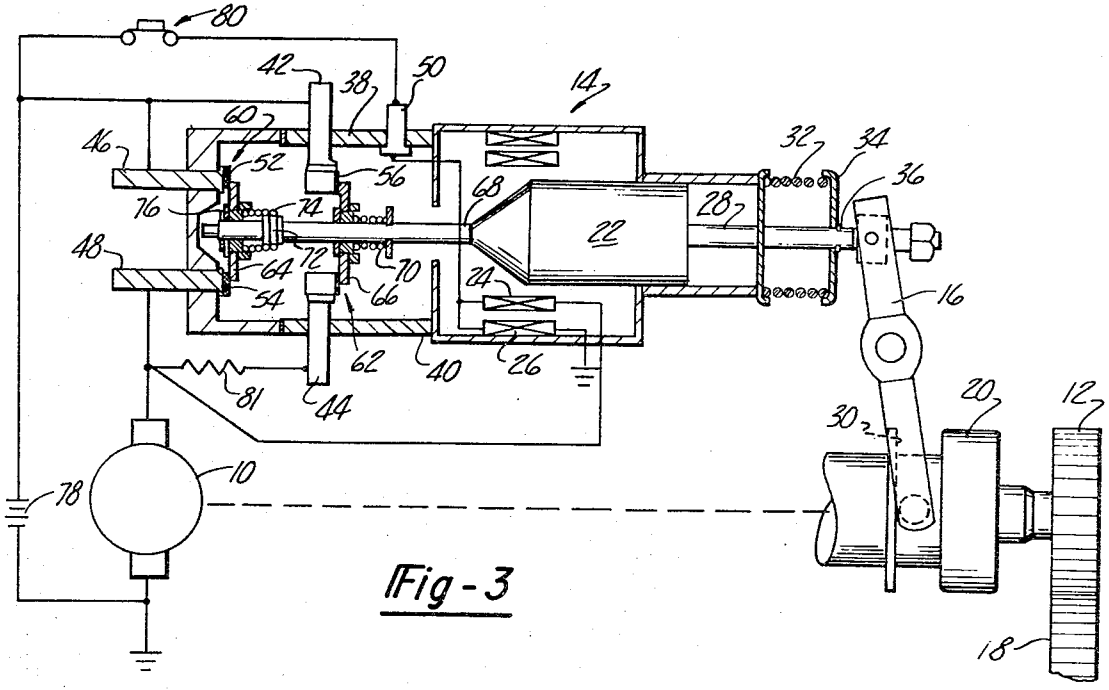
FIG. 3 shows the disclosed starter drive system in the energized state with both switches closed and full engagement of the pinion gear with the driven gear.

The relationship between the solenoid actuator's armature 22 and its actuator shaft 28, the resilient biasing means including the coil spring 32, the retainer 34, the shifting mechanism 16 and the pinion gear 12 are of a conventional arrangement and need not be discussed in detail. Briefly, with the pull-in and hold-in coils in a de-energized condition, the armature 22 and the attached actuator, shaft 28 are displaced to the right by the biasing force of the coil spring 32. The shifting mechanism 16 is rotated about the intermediate pivot point to its clockwise most position displacing the pinion gear 12 to the left where it is disengaged from the cranking gear 18. Energizing the pull-in coil 24 displaces the armature 22 to the left against the force of the coil spring 32 and the actuator shaft 28 which causes the shifting mechanism 16 to rotate counter-clockwise about its intermediate pivot point. The counter-clockwise rotation of the shifting mechanism 16 displaces the pinion gear 12 to the right and into engagement with the cranking gear 18 as shown in FIG. 3.

At the opposite end of the solenoid actuator 14, i.e., the left end as illustrated in FIG. 1, is a dual stage switch mechanism 38 including a housing 40, a first set of electrodes 42 and 44, a second set of electrodes 46 and 48 and an electrical feed-through 50. The electrodes 42 through 48 pass through the housing 40 as shown and the external portions form contact terminals for external electrical connection to the electrodes. The inner portions of electrodes are contact poles 52 through 58 for a pair of normally open switches 60 and 62, respectively. The normally open switch 60 includes the contact poles 52 and 54 and a first contact disc 64 resiliently mounted at or near the end of, and electrically insulated from, a switch, shaft 68 attached to the armature 22. The normally open switch 62 includes contact poles 56 and 58 and a second contact disc 66 disposed at an intermediate point along, and electrically insulated from, the switch shaft 68. The first and second contact discs 64 and 66, respectively, are positioned along the switch shaft 68 such that the second contact disc 66 physically contacts the poles 56 and 58 closing the switch 62 at an intermediate position of the armature 22 between its unenergized biased position (extreme right in FIG. 1) and its fully actuated position (extreme left in FIG. 1). The first contact disc 64 physically contacts the contact poles 52 and 54 and the closing switch 60 just prior to the armature 22 reaching its fully actuated position (extreme left of its travel in FIG. 1). A spring 70 resiliently biases the second contact disc 66 against a stop 72 and permits the switch shaft 68 to continue to move to the left after the second contact disc 66 contacts the poles 56 and 58. In a like manner, a spring 74 biases the contact disc 64 against a stop 76 such as a "C" ring disposed in a groove at the end of the switch shaft 68.

As previously discussed, the first contact disc 64 contacts the poles 52 and 54 just prior to the armature reaching its fully actuated position. The spring 70, therefore, permits the armature 22 to go to its fully actuated position while the spring 74 holds the contact disc 64 against the poles 52 and 54.

The resilient mounting of the first contact disc 64 to the switch shaft 68 permits good electrical contact to be established and maintained between the contact poles 52 and 54 even if the contacts erode by arcing or by other electrochemical affects known in the art. The contact faces of the poles may be overlayed, as indicated by the cross hatched portion, with a noble metal or special alloy to reduce arcing and contact erosion.

Electrical power is received by the starter drive system from a source of electrical power such as battery 78. The battery 78 has one terminal connected to a common ground signified by a conventional ground symbol. The other terminal of the battery 78 is connected to the electrodes 42 and 46 which function as input terminals to the switches 60 and 62 respectively and to one terminal of a starter switch 80. The starter switch 80 may be an independent switch as illustrated, or a multiple position multiple contact switch as commonly found on modern day automotive vehicles. The other terminal of the starter switch 80 is connected to the input lead connections of the pull-in and hold-in coils 24 and 26, respectively, through the electrical feedthrough 50. The output lead of the hold-in coil 26 is connected to the common ground of the battery 78 and the output lead of the pull-in coil 24 is connected to the electrode 48. The electrode 48 functions as the output terminal of the switch 60 and is connected directly to the input terminal of the starter motor 10. The output terminal of the starter motor 10 is connected to the common ground of the battery 78. The electrode 44 functions as the output terminal of the switch 62 and is connected to the input terminal of the starter motor 10 through a resistance 81. The resistance 81 may be a piece of nichrome or resistance wire having a predetermined resistance. The impedance of the resistance 81 is selected to provide a voltage drop thereacross when connected in series with the starter motor 10, sufficient to energize the pull-in coil 24 to produce an attractive force on the armature 22 greater than the opposing force of the coil spring 32. In a practical automotive starter application, a resistance of about 0.19 ohms for resistance 81 produces the desired voltage drop.

Figure 2:
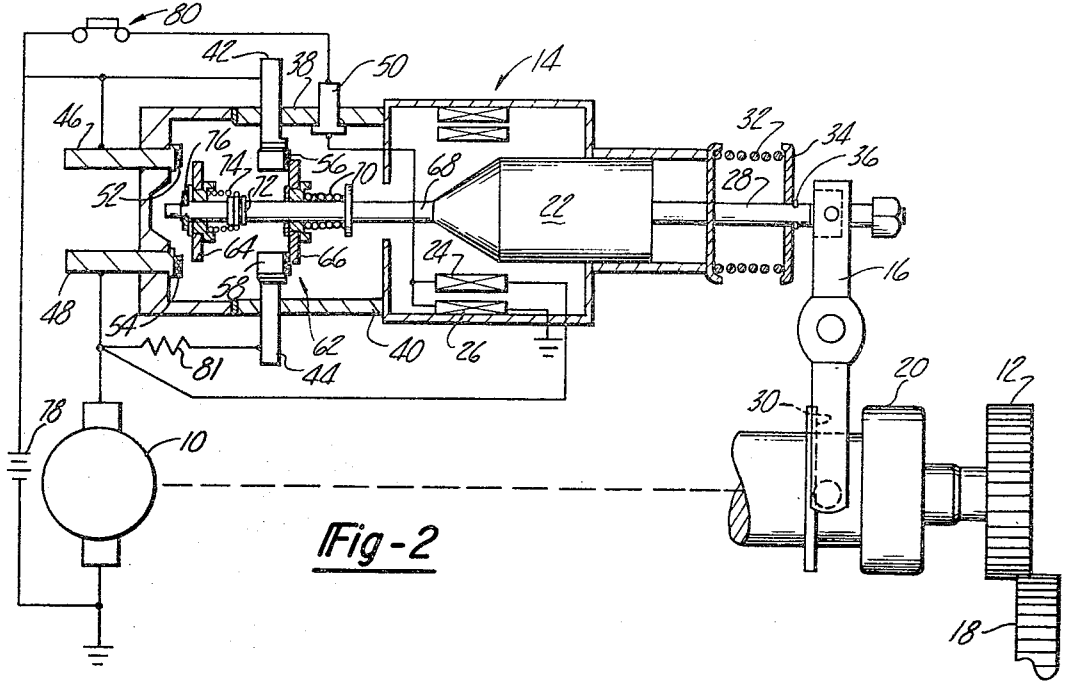
FIG. 2 shows the disclosed starter drive system in the energized state with only the first switch closed and initial engagement of the pinion gear with the driven gear.

The operation of the starter drive system is discussed with respect to FIGS. 1, 2 and 3. FIG. 2 is identical to FIG. 1 and shows the relative position of the component parts and the states of the switches 60 and 62 when the armature 22 is displaced to an intermediate position sufficient to close the switch 62. FIG. 3 shows the relative positions of the component parts and the states of the swtiches 60 and 62 when the armature 22 is in its fully actuated position.

Referring first to FIG. 1, the starter drive system is shown in its quiescent or unactuated state. The starter switch 80 is open placing the pull-in and hold-in coils 24 and 26, respectively, in an unenergized state. The armature 22 is biased to the right by the coil spring 32 and the switches 60 and 62 are in their normally open positions. The shifting mechanism 16 is rotated by the actuator shaft 28 to its extreme clockwise position displacing the pinion gear 12 to the left, out of engagement with the cranking gear 18.

Now referring to FIG. 2, the starter switch 80 is closed energizing the pull-in and hold-in coils 24 and 26, respectively. The armature 22 has responded to the magnetic fields generated by the coils 24 and 26 and has moved to an intermediate position against the biasing force of the coil spring 32. The actuator shaft 28 moves with the armature 22 and rotates the shifting mechanism 16 in a counter-clockwise direction. The counter-clockwise rotation of the shifting mechanism 16 displaces the pinion gear 12 towards the cranking gear 18. Prior to the engagement of the pinion gear 12 with the cranking gear 18, the second contact disc 66 has contacted the poles 56 and 58 closing the switch 62. The closing of the switch 62 applies electrical power to the cranking motor 10 through the resistance 81. This places an additional impedance in the motor circuit, which substantially reduces the electrical power applied to the cranking motor 10, causing its output shaft to rotate at a reduced speed and at a reduced power level. The closing of the switch 62 also reduces the potential applied across the pull-in coil 24 to the potential drop across the resistance 81 which reduces the magnetic force pulling the armature 22 to the left against the force of the coil spring 32. This reduced force also reduces the velocity at which the pinion gear 12 is moved towards the cranking gear 18. As the armature 22 continues to move to the left at the reduced velocity and with the starter motor operating at a reduced speed and power level, the pinion gear 12 is engaged with the cranking gear 18 by the continued counter-clockwise rotation of the shifting mechanism 16. This permits positive engagement to take place as the two gears are brought together without forceful indexing of the pinion gear 12 with the cranking gear 18. When abutment occurs, the reduced rotational speed of the pinion gear 12 permits engagement to occur when the next tooth engagement alignment between the pinion gear 12 and cranking gear 18 occurs.

After engagement, the armature 22 moves to the extreme left end of its travel, and the first contact disc 64 contacts the poles 52 and 54, closing the switch 60, as shown in FIG. 3, and applying full battery power to the cranking motor 10. In this position of the armature 22, the switch 62 remains closed. However, the resistance 81 is now in a parallel circuit relationship with the closed switch 60 and is effectively short circuited. The closing of the switch 60 raises the potential at the output lead of the pull-in coil 24 to the battery potential thereby deactivating the pull-in coil 24. The hold-in coil 26, having its output lead connected to the common ground, remains energized and holds the armature 22 in the fully actuated position (extreme left in FIG. 3) as long as the starter switch 80 remains closed. The system remains in this state until the starter switch 80 is opened.

When the starter switch 80 is opened, the hold-in coil 26 is deenergized and the armature returns to its quiescent or deenergized position (extreme right as shown in FIG. 1) by the action of the coil spring 32. Simultaneously, the shifting mechanism is rotated clockwise disengaging the pinion gear 12 from the cranking gear 18. The movement of the armature 22 to the right also withdraws the first and second contact discs 64 and 66 from the associated poles thereby opening the switches 60 and 62. The opening of the switches 60 and 62 terminates the electrical power being supplied to the cranking motor 10 from the battery 78 thus completing the cycle.

What is claimed is:

1. In combination with an electrically activated device of the type having an external source of electrical power; and a solenoid actuator of the type having a pull-in coil energized by said external source of electrical power; a hold-in coil energized by said external source of electrical power; a resiliently biased armature; a dual mode power switch; and means for moving said armature from a first position to a second positon in response to said external source of electrical power energizing said pull-in and hold-in coils; the improvement comprising:

said dual mode power switch comprising two normally open electrical switches sequentially closed by said means for moving the armature of said solenoid actuator from said first position to said second position, the first of said two switches having an input terminal for receiving electrical power from the external electrical power source, and an output terminal, said first switch closing in response to said means for moving said armature so that the resiliently biased armature of the solenoid actuator is displaced to a predetermined intermediate position between said first and second position, said second of said two switches having an input terminal for receiving electrical power from the external source and an output terminal connected to the output of said pull-in coil and to the input terminal of said electrically activated device, said second switch closing in response to said armature having been moved to said second position by said moving means; and a resistance having a predetermined value connected between the output terminal of said first switch and the input terminal of said electrically activated device.

2. The combination as claimed in claim 1 wherein the predetermined value of said resistance is selected to reduce the potential drop across said pull-in coil, when the first switch is closed, to a lower intermediate value than the full potential of the external source, said intermediate value of the potential drop across said pull-in coil causing said pull-in coil to continue to move said armature to said second position at a rate and with a force substantially less than the force which the armature would have had in response to the full potential of the external source.

* * * * *